US005967950A

United States Patent [19]

Hsu

[11] Patent Number: 5,967,950

[45] Date of Patent: Oct. 19, 1999

[54] LOAD MECHANISM OF BODY BUILDING DEVICE

[76] Inventor: Hank Hsu, 8F-14, No. 16, Lane 609, Sec. 5, Chung Hsin Rd., Sanchung, Taiwan

[21] Appl. No.: 09/031,070

[22] Filed: Feb. 26, 1998

[51] Int. Cl.[6] ..... A63B 21/02

[52] U.S. Cl. ..... 482/96; 482/142; 482/132; 482/110; 482/130

[58] Field of Search ..... 482/94, 95, 96, 482/104, 110, 142, 144, 143, 145, 121, 129, 130

[56] References Cited

U.S. PATENT DOCUMENTS

| | | | |
|---|---|---|---|
| 339,638 | 4/1886 | Goldie | 482/96 |
| 2,783,045 | 2/1957 | Bosche | 482/96 |
| 3,658,327 | 4/1972 | Thiede | 482/96 |
| 4,101,124 | 7/1978 | Mahnke | 482/96 |
| 4,340,218 | 7/1982 | Wilkinson | 482/129 |
| 4,489,936 | 12/1984 | Dal Monte | 482/96 |
| 4,706,953 | 11/1987 | Graham | 482/96 |
| 5,263,913 | 11/1993 | Boren | 482/95 |
| 5,346,447 | 9/1994 | Stearns | 482/95 X |
| 5,433,685 | 7/1995 | Winslow | 482/96 |
| 5,674,168 | 10/1997 | Wilkinson | 482/138 |
| 5,792,033 | 8/1998 | Merrithew | 482/96 |

*Primary Examiner*—Richard J. Apley
*Assistant Examiner*—William LaMarca
*Attorney, Agent, or Firm*—Browdy and Neimark

[57] ABSTRACT

A load mechanism is intended for use in a body building device and is composed of a frame, a slide member mounted on the frame such that the slide member is capable of sliding back and forth between a first position and a second position along a fixed path, at least one resilient member fastened at both ends thereof with the slide member and the frame for holding the slide member at the first position, and at least one pull cord for actuating the slide member to slide on the frame toward the second position.

5 Claims, 8 Drawing Sheets

LOAD MECHANISM OF BODY BUILDING DEVICE

FIELD OF THE INVENTION

The present invention relates generally to a body building device, and more particularly to a load mechanism of the body building device.

BACKGROUND OF THE INVENTION

The conventional body building device is generally composed of a load mechanism consisting of a plurality of oil pressure rods. These oil pressure rods are complicated in construction and are composed of an outer cylinder, a shaft rod, oil, and sealing elements. The oil pressure load mechanism is defective in design in that the chemical and the physical properties of oil contained in the oil pressure rods are susceptible to change after the prolonged use of the body building device, and that the expansion resisting force of the shaft rod is fixed and can not be adjusted, thereby limiting the application of the oil pressure load mechanism to the exercise device. In addition, the expansion speed of the shaft rod of the oil pressure rods is rather slow and is therefore not well accepted by the consumers at large.

SUMMARY OF THE INVENTION

The primary objective of the present invention is therefore to provide a body building device with a load mechanism which is durable and can be adjusted in magnitude of resisting force.

In keeping with the principle of the present invention, the foregoing objective of the present invention is attained by a load mechanism consisting of a frame, a slide member, at least one resilient member, and at least one pull cord. The slide member is mounted on the frame such that the slide member is capable of sliding back and forth along a fixed path between a first position and a second position on the frame. The resilient member is fastened at both ends thereof with the slide member and the frame for keeping the slide member at the first position. The pull cord is intended to pull the slide member to slide toward the second position.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
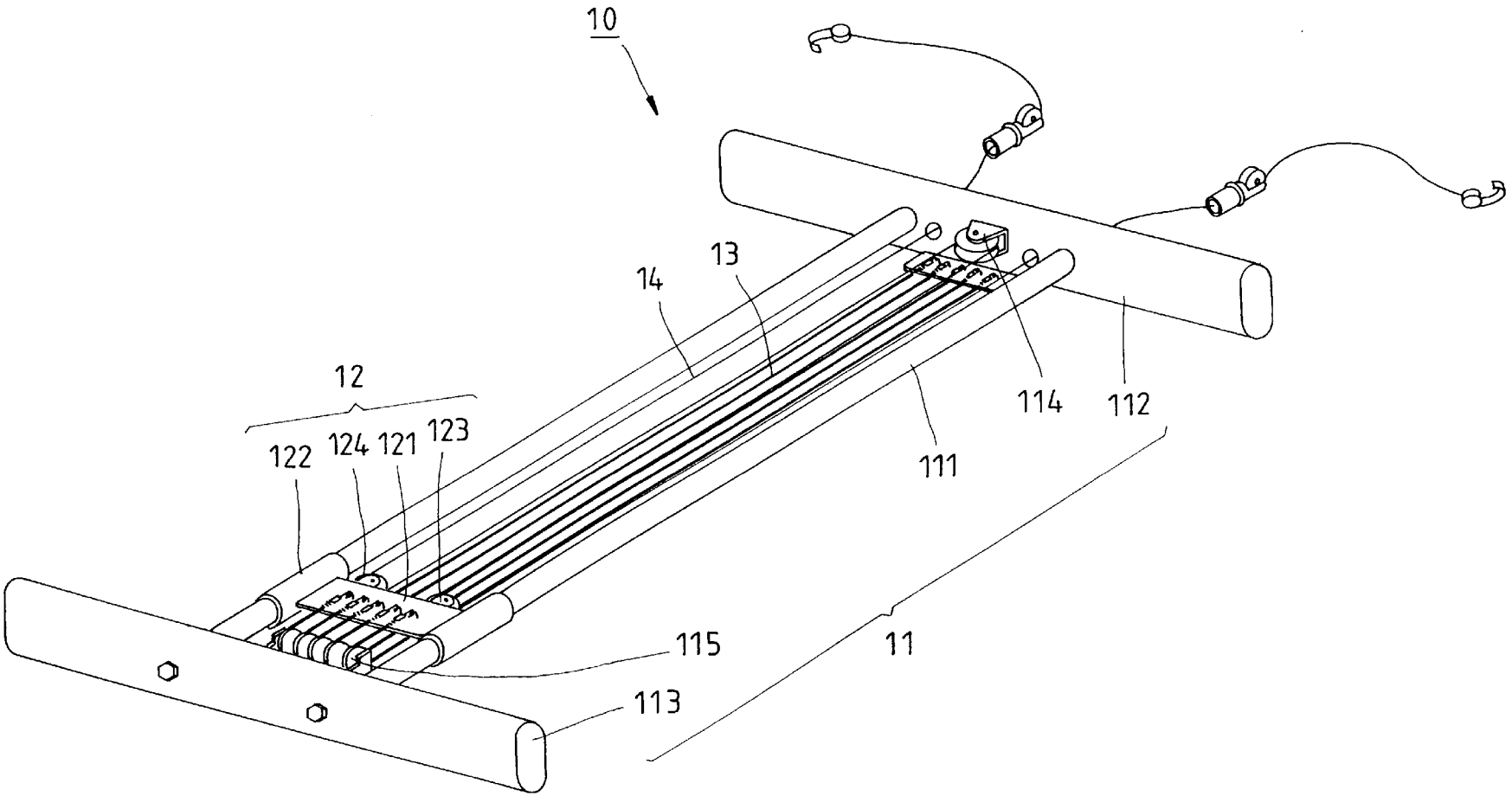
FIG. 1 shows a perspective view of the present invention.

As shown in FIG. 1, a load mechanism 10 embodied in the present invention is intended for use in a body building device and is composed of the component parts, which are described hereinafter.

A frame 11 has two slide rods 111 parallel to each other, a front cross rod 112 fastened with front ends of the two slide rods 111, a rear cross rod 113 fastened with rear ends of the two slide rods 111, and a first pulley 114.

A slide member 12 has a connection plate 121, two slide jackets 122 fastened with both ends of the connection plate 121, and a second pulley 123 and a third pulley 124. The slide member 12 is connected with the two slide rods 111 by means of two slide jackets 122 such that the slide member 12 is capable of sliding back and forth between the front end and the rear end of the two slide rods 111.

A plurality of resilient members 13 of a rubber material are engaged respectively at one end thereof with the front cross rod 112 such that the resilient members 13 are wound around the pulley 115 mounted on the rear cross rod 113. The resilient members 13 are engaged respectively at another end thereof with the connection plate. The slide member 12 is therefore kept at the rear ends of the two slide rods 111, thanks to the elastic force of the resilient member 13.

A pull cord 14 is wound on the second pulley 123, the first pulley 114 and the third pulley 124. As both ends of the pull cord 14 are pulled, the slide member 12 is actuated to move toward the front end of the two slide rods 111.

When the slide member 12 is exerted on by the force of the resilient member 13, the slide member 12 is thus located at the rear end of the two slide rods 111. When both ends of the pull cord 14 are exerted on by a pull force greater than the sum of elastic forces of the resilient member 13, the slide member 12 is actuated to move along the two slide rods 111 toward the front ends of the slide rods 111. When the pull cord 14 is relieved of the pull force or when the pull force is smaller than the sum of elastic forces of the resilient member 13, the slide member 12 moves along the slide rods 111 toward the rear ends of the slide rods 111. As a result, both ends of the pull cord 14 may be linked with a link mechanism or a force applying mechanism to act as a load having a resisting force.

Figure 2:
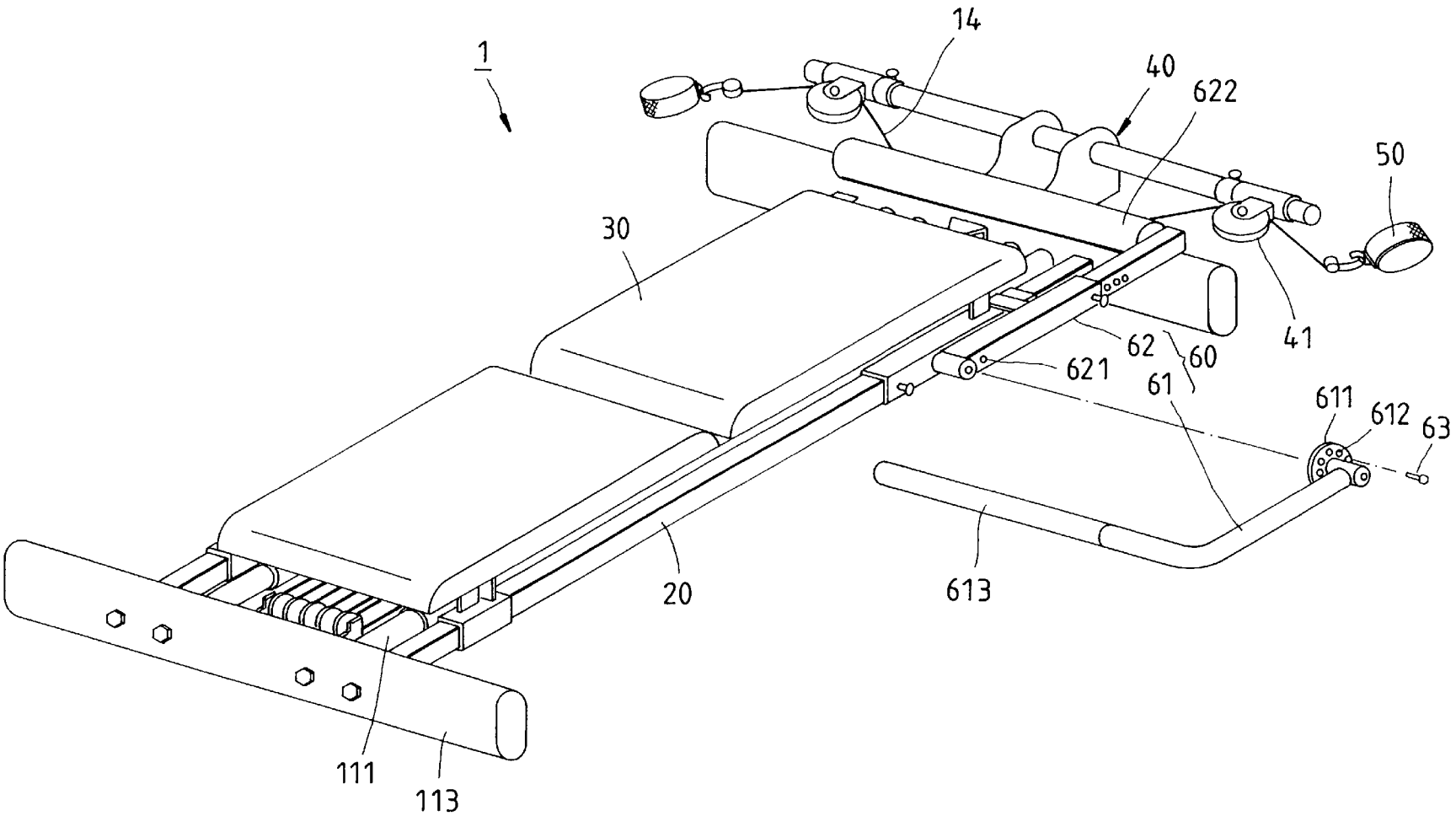
FIG. 2 shows a perspective view of a body building device comprising the load mechanism of the present invention, with some of the component parts being denoted by the dotted lines.

As shown in FIG. 2, a body building device 1 is provided with the load mechanism 10 of the present invention and two support rods 20 which are respectively connected at both ends thereof with the front cross rod 112 and the rear cross rod 113. The two support rods 20 are located on both sides of the two slide rods 111. A pad 30 is fastened on the two support rods 20. A support frame 40 is provided with two pulleys 41 fastened at both ends thereof such that both ends of the pull cord 14 are wound on the pulleys 41. Both ends of the pull cord 14 are provided with two pull jackets 50. A belly exercise mechanism 60 is composed of an input rod 61 and an output rod 62 which are fastened pivotally with one of the two support rods 111. The input rod 61 is provided at the pivoting end thereof with a graduated disk 611 having a plurality of degree holes 612. The output rod 62 is provided with a locating hole 621. When the input rod 61 turns in relation to the output rod 62, the holes 612 are sequentially coincident with the locating hole 621. The input rod 61 and the output rod 62 are located to form an angle by a pin 63 which is inserted into the degree hole 612 and the locating hole 621. The input rod 61 is provided at the free end thereof with a force applying grip rod 613, whereas the output rod 62 is provided at the free end thereof with a rest rod 622.

Figure 3:
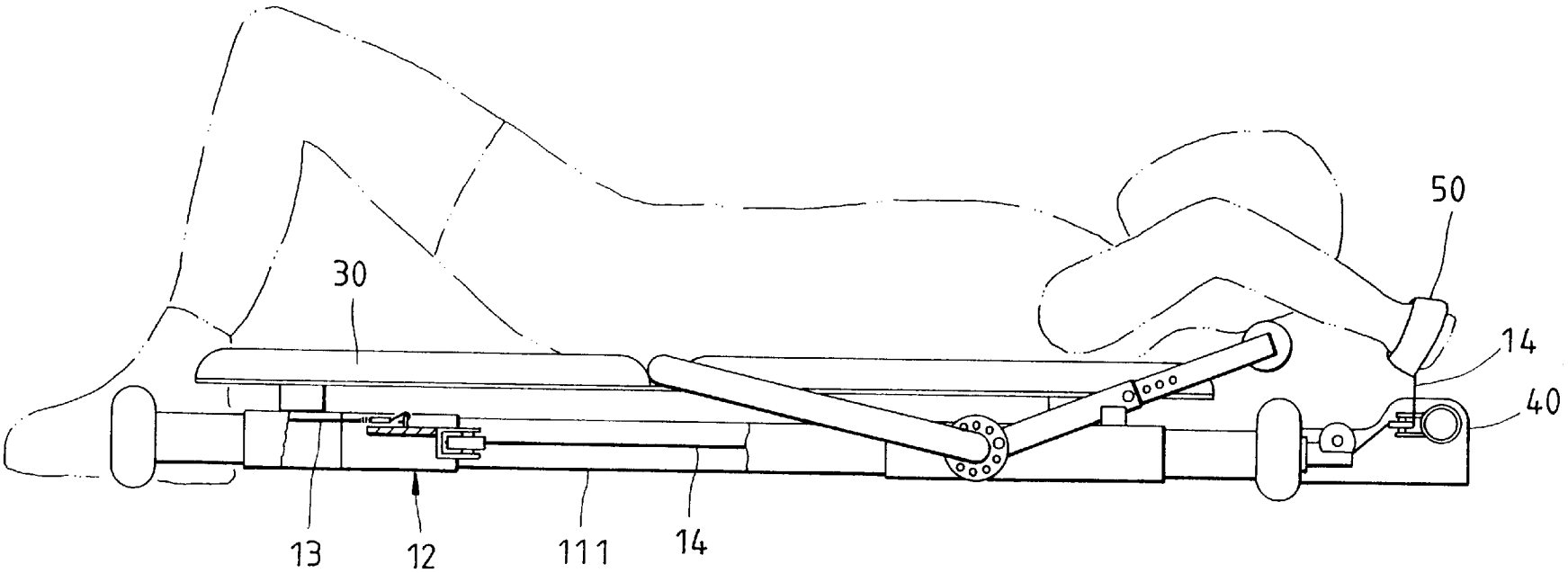
FIGS. 3–4 show operational schematic views of the body building device as shown in FIG. 2.
Figure 4:
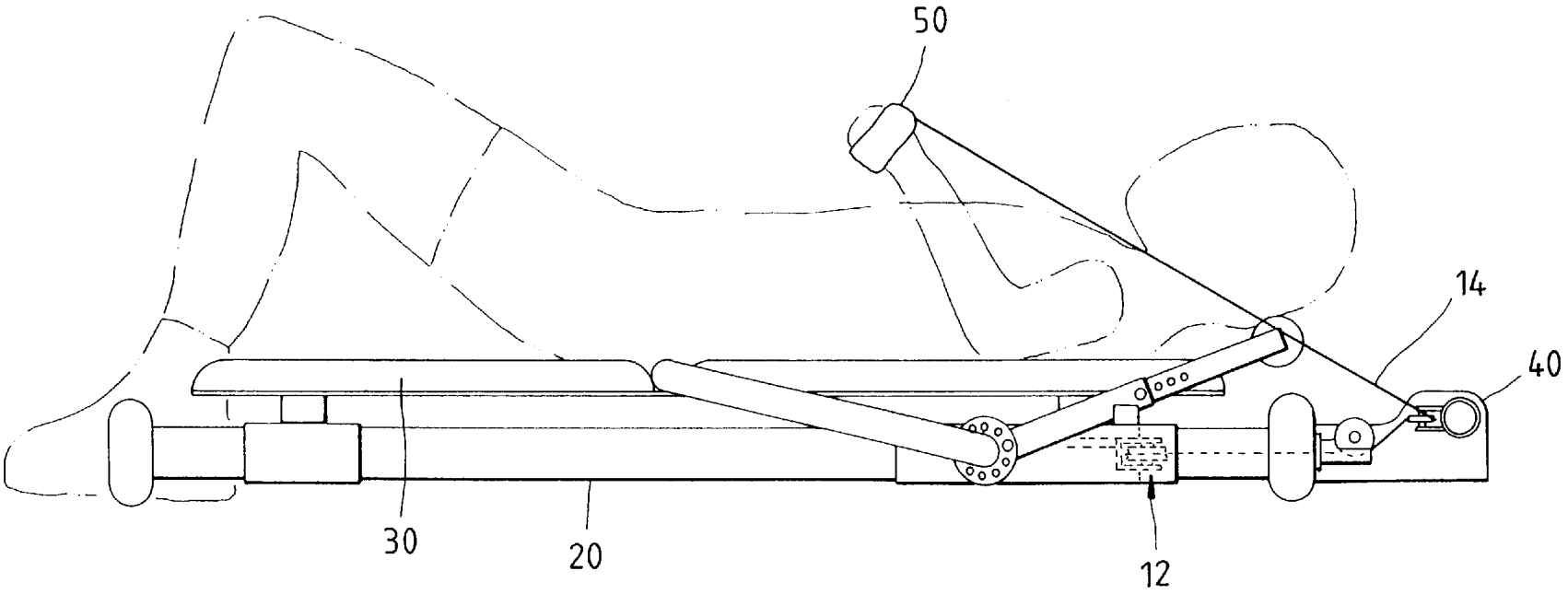

As shown in FIGS. 3 and 4, a user lies on the pad 30, with his or her head facing the support frame 40 and with his or her hands holding the two rings 50. When the pull cord 14 is pulled, the slide member 12 moves along the slide rods 111 toward the head end of the two slide rods 111, as shown in FIG. 4. When the pull cord 14 is relieved of the pull force, the slide member 12 is acted on by the resilient member 13 to move back to the rear end of the slide rods 111, as shown in FIG. 3. A hand exercise is thus brought about.

The source of the resisting force of the load mechanism 10 is the resilient member 13. As a result, the magnitude of the resisting force of the load mechanism 10 is dependent on the quantity of the resilient members 13. The magnitude of the resisting force of the load mechanism 10 can be therefore adjusted by adjusting the quantity of the resilient member 13.

The speed at which the slide member 12 slides on the slide rods 111 is directly proportional to the magnitude of the pulling force by which the pull cord 14 is on.

The load mechanism 10 is simple in construction and cost-effective. In addition, the load mechanism 10 is durable.

Figure 5:
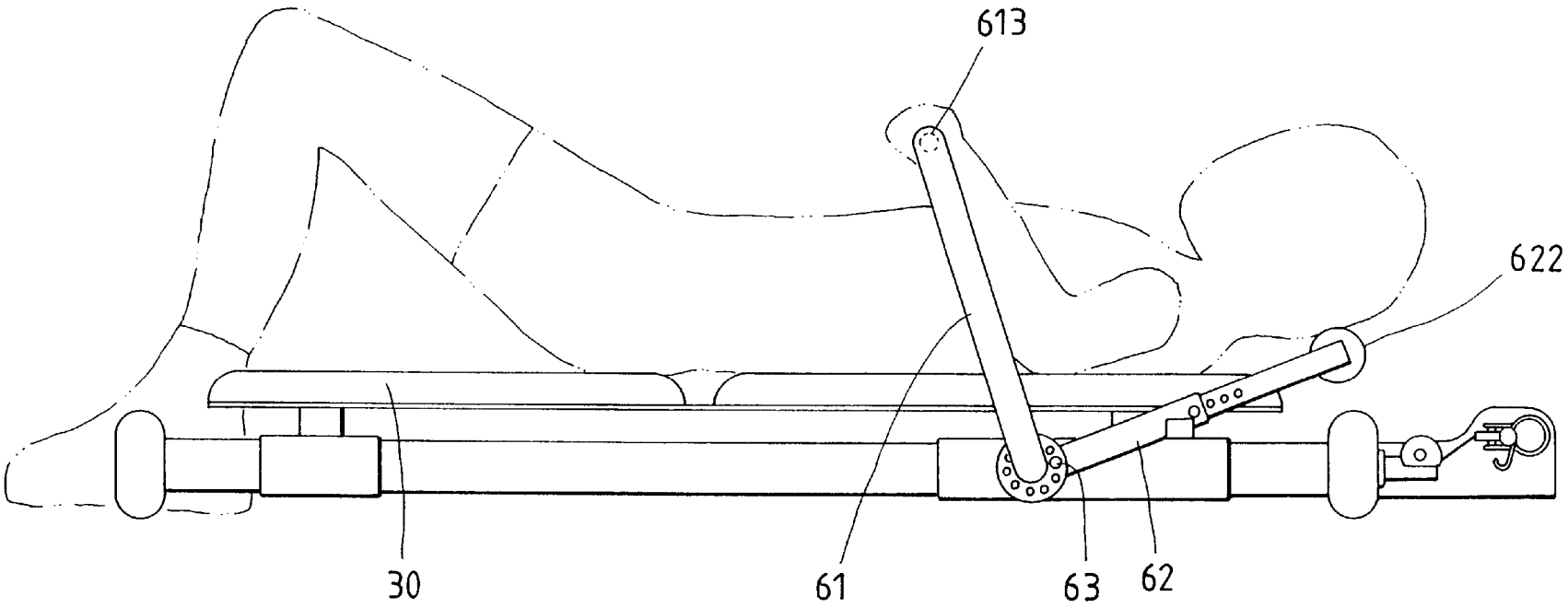
FIGS. 5–6 show another operational schematic views of the body building device as shown in FIG. 2.
Figure 6:
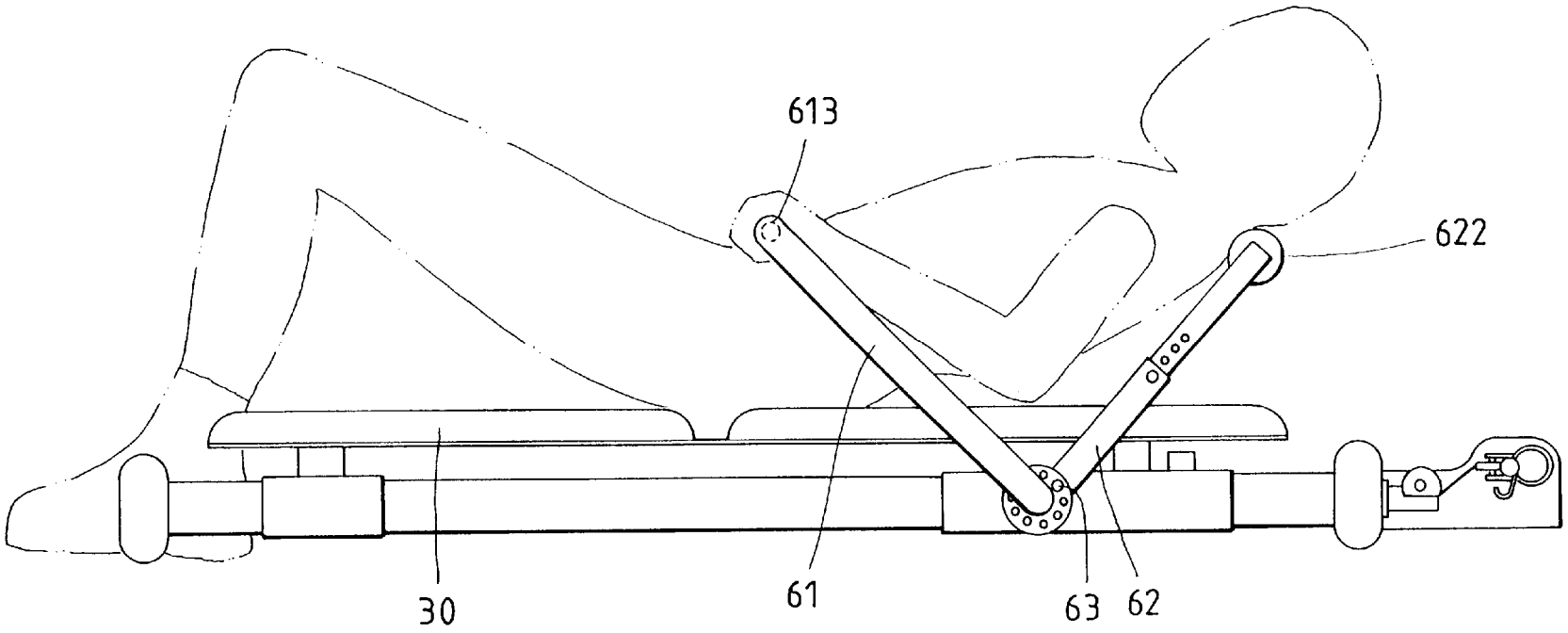

As shown in FIGS. 5 and 6, the exercise device 1 can be used as an auxiliary device for a belly exercise. The angle formed by the input rod 61 and the output rod 62 is first adjusted and then fixed by the pin 63. The user then lies on the pad 30 such that the neck of the user rests on the rest rod 62, and that both hands hold the force applying grip 613, which is then forced downwards to force the input rod 61 to turn downward, thereby actuating the output rod 62 to turn upwards so as to support the neck.

Figure 7:
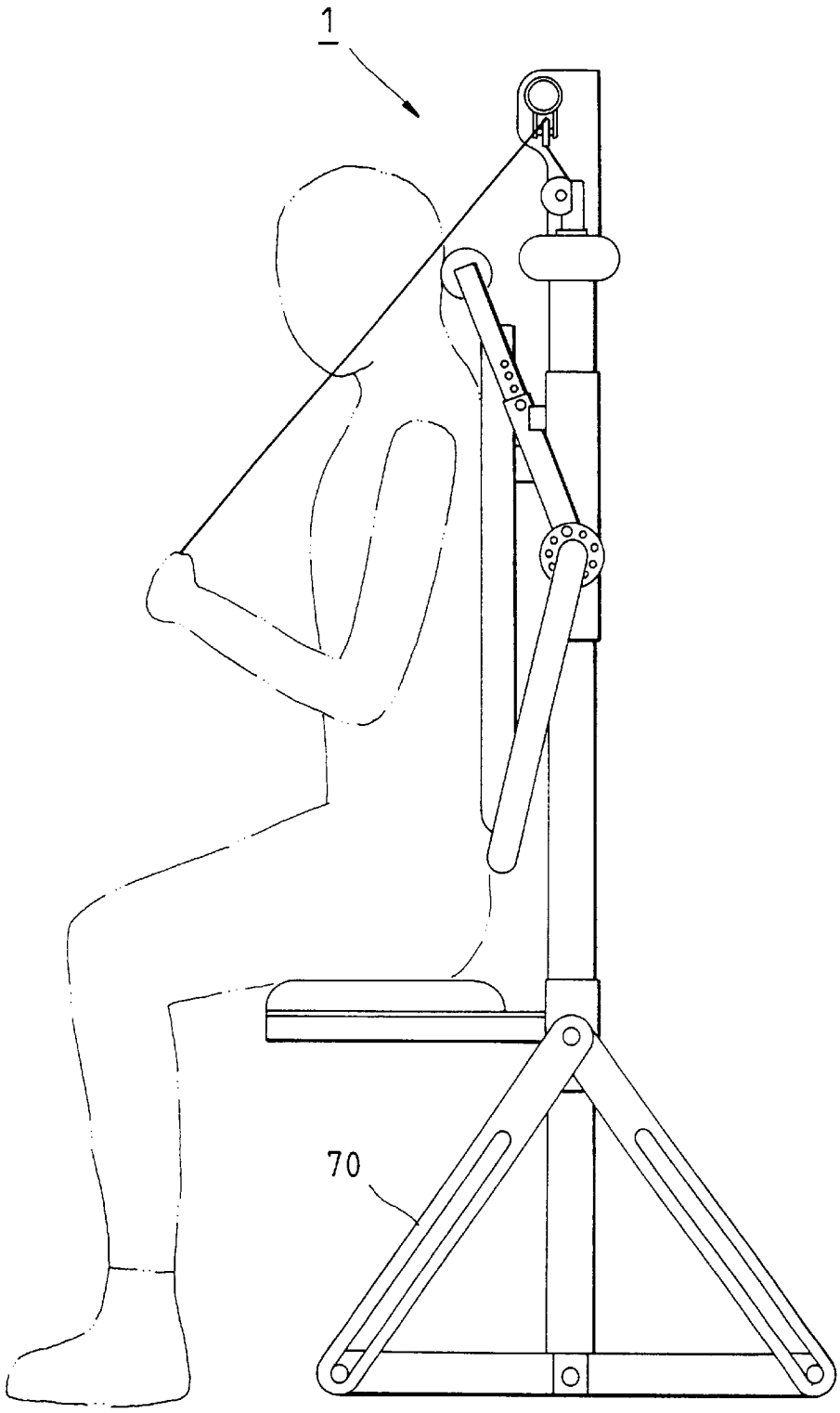
FIGS. 7–8 show still another operational schematic views of the body building device as shown in FIG. 2.

As shown in FIG. 7, the body building device 1 can be erected on the ground by means of a support frame 70. The user can be seated for doing a hand-pulling training.

Figure 8:
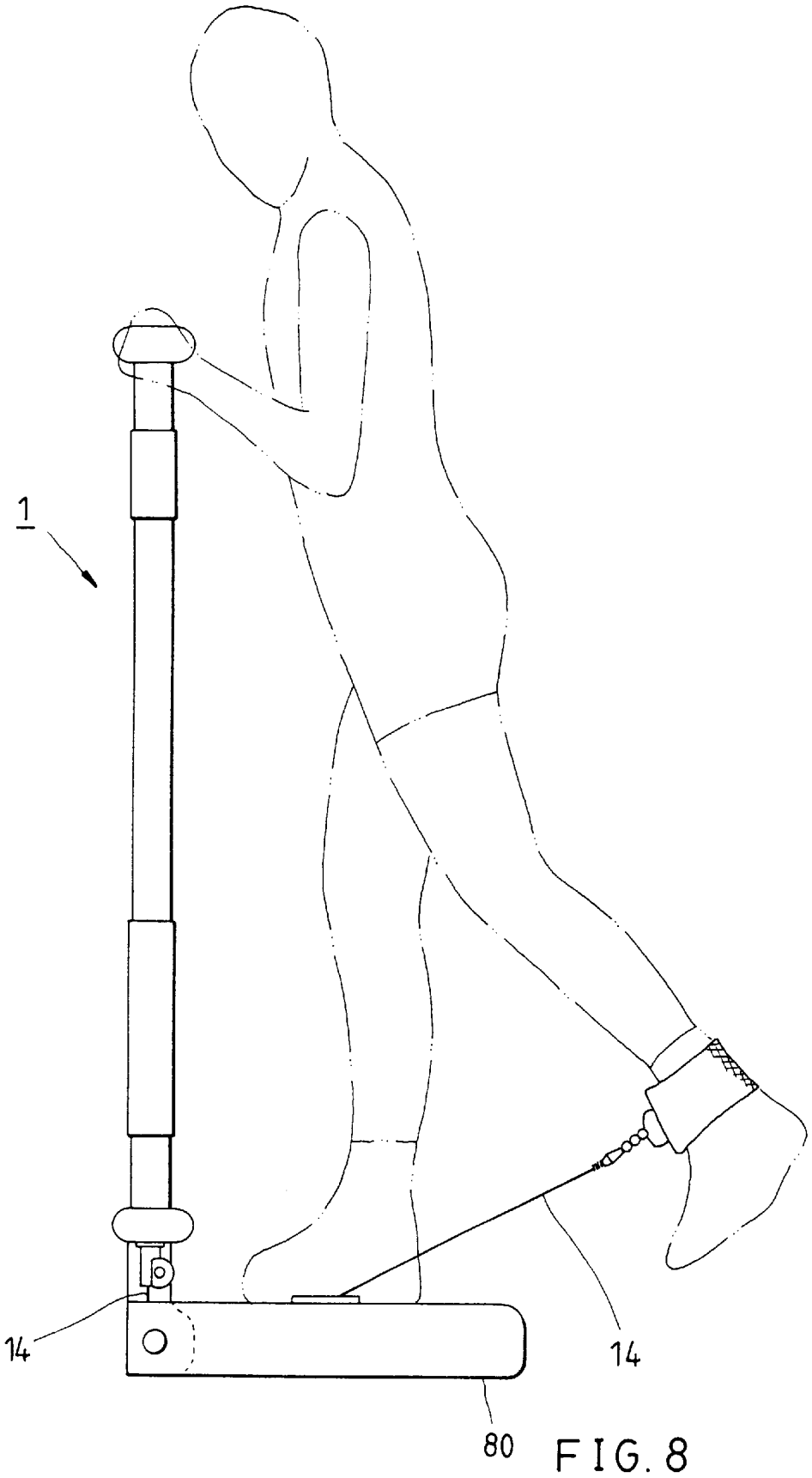

As shown in FIG. 8, the body building device 1 has a support frame 40 on which a pedal 80 is mounted. The user may stand up on the floor by means of the pedal 80. Both feet tread the pedal 80 such that the feet are held securely by the two rings 50, and that the pull cord 14 is exerted on by both feet for training the muscles of both feet.

What is claimed is:

1. A load mechanism of a body-building device, said load mechanism comprising:

a frame;

a slide member mounted on said frame such that said slide member is capable of sliding back and forth between a first position and a second position along a fixed path;

at least one resilient member fastened at both ends thereof with said slide member and said frame for holding said slide member at the first position; and at least one pull cord for actuating said slide member to slide on said frame toward the second position;

wherein said frame has two parallel slide rods provided with two sliding jackets for fastening said slide member with said slide rods such that said slide member is capable of sliding between front ends and rear ends of said two slide rods;

wherein said front ends and said rear ends of said two slide rods are connected with a front cross rod and a rear cross rod, said front cross rod provided with a first pulley, said sliding jackets connected with a connection plate provided with a second pulley and a third pulley, said pull cord being wound on said second pulley, said first pulley and said third pulley, such that said pull cord is capable of actuating said slide member to slide toward said front ends of said two slide rods;

wherein said slide rods are provided respectively with a support rod which is connected with said front cross rod and said rear cross rod, said support rods provided with a pad fastened thereon, said front cross rod fastened with a support frame provided with two pulleys for winding said pull cord which is provided respectively at both ends thereof with a pull jacket, so as to form a body building device.

2. The load mechanism as defined in claim 1, wherein said resilient member is made of a rubber material.

3. The load mechanism as defined in claim 1, wherein said body building device is provided with a bell training auxiliary mechanism and composed of an input rod and an output rod, which are fastened pivotally and coaxially with one of said two support rods, said input rod provided at a pivoting end thereof with a graduated disk having a plurality of degree holes, said output rod provided with a locating hole capable of being coincident with said degree holes at such time when said input rod is turned in relation to said output rod, said input rod and said output rod being located by a pin which is received in said locating hole and one of said degree hole, said input rod provided at a free end thereof with a force applying grip, said output rod provided at a tree end thereof with a rest rod.

4. The load mechanism as defined in claim 1, wherein said body building device is provided with a support frame enabling said body building device to be erected uprightly on a surface for doing a hand muscle exercise by an exerciser who is seated.

5. The load mechanism as defined in claim 1, wherein said support frame of said body building device is provided with a pedal enabling said body building device to be placed uprightly on a floor for doing a leg muscle exercise;

wherein two securement rings for receiving the legs of a user are attached to the end of the pull cord so that the legs of the user when standing on the pedal can exert a pull force on the pull cord.

* * * * *